US008925403B2

(12) United States Patent
Ikemori et al.

(10) Patent No.: US 8,925,403 B2
(45) Date of Patent: Jan. 6, 2015

(54) STARTER

(75) Inventors: Tomohiko Ikemori, Kiryu (JP); Mitsuhiro Kogure, Kiryu (JP); Isao Hagiwara, Kiryu (JP); Chihiro Horikoshi, Kiryu (JP); Ken Noguchi, Kiryu (JP)

(73) Assignee: Mitsuba Corporation, Kiryu-shi (JP)

( * ) Notice: Subject to any disclaimer, the term of this patent is extended or adjusted under 35 U.S.C. 154(b) by 201 days.

(21) Appl. No.: 13/410,801

(22) Filed: Mar. 2, 2012

(65) Prior Publication Data

US 2012/0247270 A1 Oct. 4, 2012

(30) Foreign Application Priority Data

Mar. 4, 2011 (JP) ..... 2011-047558

(51) Int. Cl.

| | |
|---|---|
| ***F02N 11/00*** | (2006.01) |
| ***F02N 15/00*** | (2006.01) |
| ***F02N 15/06*** | (2006.01) |
| ***F02N 11/08*** | (2006.01) |
| ***H01H 51/06*** | (2006.01) |

(52) U.S. Cl.

CPC ..... *F02N 15/067* (2013.01); *F02N 11/087* (2013.01); *F02N 15/06* (2013.01); *H01H 51/065* (2013.01)

USPC ..... 74/7 R; 74/7 E

(58) Field of Classification Search

USPC ..... 74/7 R, 7 A, 7 E; 310/89

See application file for complete search history.

(56) References Cited

U.S. PATENT DOCUMENTS

| | | | | |
|---|---|---|---|---|
| 5,735,169 | A * | 4/1998 | Niimi et al. | 74/7 A |
| 6,443,023 | B1 * | 9/2002 | Kajino et al. | 74/7 E |
| 6,809,446 | B2 * | 10/2004 | Yamamoto et al. | 310/89 |
| 2012/0090910 | A1 * | 4/2012 | Lang | 180/271 |

FOREIGN PATENT DOCUMENTS

| | | |
|---|---|---|
| JP | 2003-161237 | 6/2003 |
| JP | 2007-132296 | 5/2007 |
| JP | 2010-144552 | 7/2010 |

OTHER PUBLICATIONS

Office Action dated Apr. 22, 2014 issued in JP application No. 2011-047558.

* cited by examiner

*Primary Examiner* — William C Joyce
(74) *Attorney, Agent, or Firm* — Kenyon & Kenyon LLP

(57) ABSTRACT

A starter includes a motor section; an output shaft which rotates with receiving a rotational force of the motor section; a gear mechanism which transmits the rotational force of the output shaft to a ring gear of an engine; and a switch unit which performs electrical connection and disconnection to the motor section. Thus, the output shaft, the gear mechanism and the switch unit are accommodated in a housing, and a groove section for weakening the stiffness of the housing is formed in housing at a position which avoids a position where the switch unit is arranged.

6 Claims, 4 Drawing Sheets

STARTER

BACKGROUND OF THE INVENTION

1. Field of the Invention

The present invention relates to a starter, for example, mounted on a vehicle.

This application claims benefit of Japanese Patent Application No. 2011-047558 filed on Mar. 4, 2011 which is hereby incorporated by reference.

2. Description of Related Art

A starter used for starting a vehicle is known which includes in a housing, a motor section (a motor), an electromagnetic switch opening and closing a main contact disposed at a motor circuit, a pinion shaft which rotates driven by the motor section, a pinion gear integrally supported with a clutch by the pinion shaft, an intermediate shaft arranged parallel to the pinion shaft, an intermediate gear supported on the intermediate shaft, and a retainer connecting the pinion gear and the intermediate gear (a member that retains the pinion gear and the intermediate gear by connecting both each other). Thus, the starter includes a configuration in which the intermediate gear moves integrally with the pinion gear through the retainer and thereby meshes with a ring gear of an engine.

The electromagnetic switch forms an electromagnet by electrical connection to an electromagnetic coil. The electromagnetic switch has a solenoid driving (attracting) a plunger with an attraction force of the electromagnet, and a contact cover fixed at the solenoid and made of resin. The main contact is arranged inside the contact cover. In addition, the clutch is connected to the plunger of the electromagnetic switch through a shift lever. Thus, the movement of the plunger is transmitted through the shift lever and thereby the clutch moves on the pinion shaft in an axial direction with the action of a helical spline.

Under such a configuration, when the electromagnetic switch is electrically connected to the electromagnetic coil to form the electromagnet, the plunger is attracted and moved to the electromagnet. When the movement of the plunger is transmitted to the clutch through the shift lever, the pinion gear moves integrally with the clutch on the pinion shaft in a direction opposite to the motor section, and at the same time, the intermediate gear connected to the pinion gear by the retainer moves in a meshed state with the pinion gear.

In addition, when the main contact is closed by the electromagnetic switch, the power is supplied from an in-vehicle battery to the motor section and thereby rotational force is generated at an armature. Thus, the rotational force is transmitted to the pinion shaft through a reduction gear. The rotation of the pinion shaft is transmitted to the pinion gear through the clutch and furthermore, transmitted to the intermediate gear meshed with the pinion gear. Thus, a driving torque of the motor section is transmitted from the pinion gear to the ring gear through the intermediate gear and thereby cranking the engine (for example, see Japanese Unexamined Patent Application, First Publication No. 2007-132296).

However, in the related art described above, when an excessive load is applied to the starter, for example, during a collision at the front of the vehicle, the housing may be deformed. In this case, when the deformed portion of the housing is, for example, a portion corresponding to the electromagnetic switch or the shift lever, the electromagnetic switch, the shift lever or the like may be deformed according to the deformation of the housing. When the electromagnetic switch, the shift lever or the like is deformed, the main contact may be closed. In this case, unnecessary power may be supplied to the motor section.

The invention has been made in light of such circumstances, and has an object of providing a starter which can reliably prevent supplying an unnecessary power to a motor section even though an excessive load is applied.

SUMMARY OF INVENTION

According to a first aspect of the invention, a starter includes a motor section; an output shaft which rotates by receiving a rotational force of the motor section; a gear mechanism which transmits a rotational force of the output shaft to a ring gear of an engine; a contact mechanism which performs electrical connection and disconnection to the motor section; and a gear movement mechanism which moves the gear mechanism according to the operation of the electrical connection and disconnection of the contact mechanism and coordinates the gear mechanism and the ring gear. Thus, a fragile section is disposed at a portion which avoids the contact mechanism.

With the configuration described above, when an excessive load is applied to the starter, a stress concentrates on the fragile section provided at the portion which avoids the contact mechanism, and the fragile section is deformed. Thus, the influence of the load applied to the starter toward the contact mechanism can be avoided. In addition, unnecessary power can be reliably prevented from supplying to the motor section by being closed the contact mechanism.

According to a second aspect of the invention, at least the output shaft, the gear mechanism, the contact mechanism and the gear movement mechanism are accommodated in a housing. Furthermore, a housing groove section for weakening the stiffness of the housing is formed at a position which avoids the portion where the contact mechanism of the housing is arranged. Furthermore, the housing groove section is set as the fragile section.

With the configuration described above, when an excessive load is applied to the starter, a stress concentrates on the housing groove section and the housing is deformed about the housing groove section. Thus, the influence on contact mechanism of the deformation of the housing can be avoided. Accordingly, when the excessive load is applied to the starter, unnecessary power can be reliably prevented from being supplied to the motor section by being closed the contact mechanism with a simple structure.

According to a third aspect of the invention, the gear movement mechanism has a lever connecting the gear mechanism and the contact mechanism. Furthermore, a lever groove section for reducing the stiffness of the lever is formed at the lever. Furthermore, the lever groove section is set as the fragile section.

With the configuration described above, for example, when a load received from the gear mechanism side is transmitted to the contact mechanism through the lever, if a load having a predetermined size or more is transmitted, the lever is deformed about the lever groove section and the transmission of the load to the contact mechanism side is suppressed. Thus, the unnecessary power can be reliably prevented from being supplied to the motor section by the contact mechanism being closed by the load.

According to a fourth aspect of the invention, the gear movement mechanism has a lever connecting the gear mechanism and the contact mechanism. Furthermore, an easy releasing section which easily releases the connection of at least one of the gear mechanism and the contact mechanism with the lever is disposed at the lever.

With the configuration described above, for example, when a load received from the gear mechanism side is transmitted to the contact mechanism through the lever, if a load having a predetermined size or more is transmitted, connection of at least one of the gear mechanism and the contact mechanism with the lever is released. Thus, a load received from the gear mechanism side can be prevented from transmitting to the contact mechanism side through the lever. Thus, the unnecessary power can be reliably prevented from being supplied to the motor section by the contact mechanism being closed by the load.

According to a fifth aspect of the invention, the output shaft and the gear mechanism are disposed at one side of the housing. Furthermore, the contact mechanism is disposed at the other side of the housing and the housing groove section is formed at one side rather than a position where the contact mechanism of the housing is disposed.

With the configuration described above, when an excessive load is applied to the starter, the contact mechanism is further reliably prevented from closing.

According to a sixth aspect of the invention, the housing groove section is formed over an entire circumferential direction of the housing.

With the configuration described above, when an excessive load is applied to the starter, the contact mechanism is further reliably prevented from closing.

According to the aspects of the invention, when an excessive load is applied to the starter, a stress concentrates on the fragile section which is provided at the portion which avoids the contact mechanism, and the fragile section deforms. Thus, influence on the contact mechanism of the load applied to the starter can be avoided, and unnecessary power can be reliably prevented from being supplied to the motor section bu the contact mechanism being closed.

DETAILED DESCRIPTION OF THE PREFERRED EMBODIMENTS

First Embodiment (Starter)

Next, a first embodiment of the invention will be described with reference to FIGS. 1 to 3.

Figure 1:
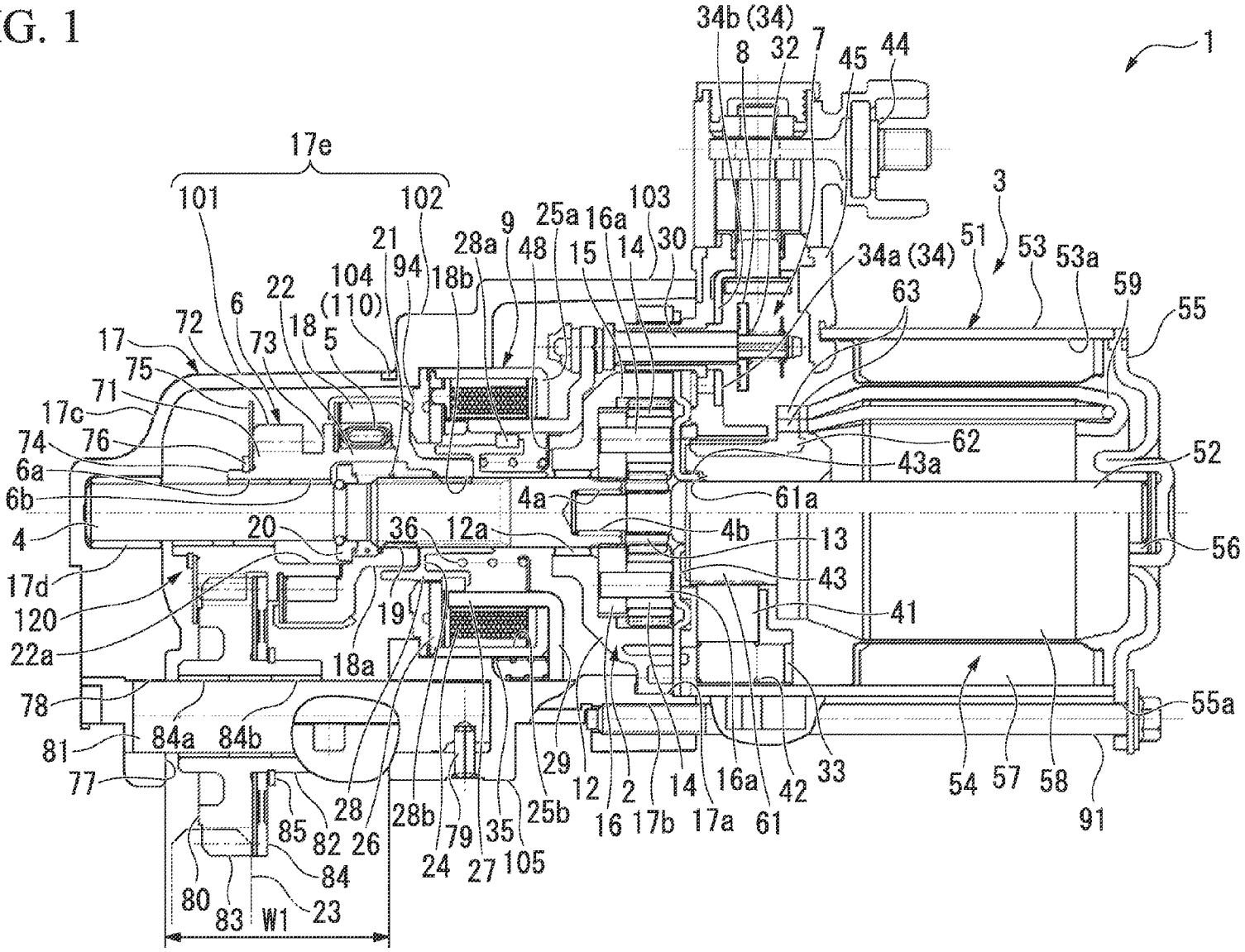
FIG. 1 is a cross-sectional view of a starter in a first embodiment of the invention.

FIG. 1 is a cross-sectional view of the starter. In FIG. 1, a stationary state is shown above the center line and a conducting state is shown below the center line.

As shown in the same view, a starter 1 is a member for generating the rotational force required to start an engine (not shown). The starter 1 includes a motor section 3, an output shaft 4 connected to the motor section 3, gear mechanism 120 for transmitting the rotational force of the output shaft 4 to a ring gear 23 of engine (not shown) and an electromagnetic device 9. The electromagnetic device 9 includes a switch unit 7 opening and closing a power supply path to the motor section 3. The electromagnetic device 9 is a member for moving a movable contact plate 8 of the switch unit 7 and a pinion 6 in the axial direction (described in detail later).

The motor section 3 is configured of a DC motor 51 with brush and planetary gear mechanism 2 connected to a rotational shaft 52 of the DC motor 51 with brush and for transmitting the rotational force of the rotational shaft 52 to the output shaft 4.

The DC motor 51 with brush includes a substantially cylindrical yoke 53 and an armature 54 arranged inside the yoke 53 in the radial direction and rotatably disposed at the yoke 53.

A plurality of permanent magnets 57 is disposed on the inner circumferential surface of the yoke 53 so as to arrange magnetic poles in sequence in the circumferential direction of the inner peripheral surface of the yoke 53.

An end plate 55 closing an opening 53*a* of the yoke 53 is disposed at one end opposite the planetary gear mechanism 2 of the yoke 53. A sliding bearing 56 for rotatably supporting one end of the rotational shaft 52 is disposed at the center of the end plate 55 in the radial direction.

The armature 54 is configured of the rotational shaft 52, an armature core 58 inserted and fixed at a position corresponding to the permanent magnet 57 at the outside of the rotational shaft 52, a commutator 61 inserted and fixed at the side of the planetary gear mechanism 2 (left side in FIG. 1) rather than the armature core 58 at the outside of the rotational shaft 52.

The armature core 58 includes a plurality of teeth (not shown) formed radially and a plurality of slots (not shown) formed between each of the teeth adjacent in the circumferential direction. A coil 59 is wound by for example, wave winding between two slots having a predetermined interval in the circumferential direction. A terminal section of the coil 59 is drawn towards the commutator 61.

A plurality of segments 62 is disposed at the commutator 61 along the circumferential direction and with a predetermined interval so as to insulate each other.

A riser 63 which is formed by bending to be folded back is disposed at an end of the side of the armature core 58 of each of the segments 62. The terminal section of the coil 59 wound on the armature core 58 is connected to the riser 63.

A cylindrical top plate 12 having a bottom section is disposed at the other end of the yoke 53. The planetary gear mechanism 2 is arranged at the inner surface of the side of the armature core 58 of the top plate 12.

The planetary gear mechanism 2 is configured of a sun gear 13 inserted and fixed on the outside of the rotational shaft 52, a plurality of planet gears 14 which are meshed with the sun gear 13 and revolves around the sun gear 13, and an annular internal ring gear 15 disposed at the outer circumference side of the planet gear 14.

A plurality of the planet gears 14 are connected by a carrier plate 16. A supporting shaft 16*a* is erected and disposed at a position corresponding to each of the planet gears 14 in the carrier plate 16 and the planet gears 14 are rotatably supported at the position. In addition, one end of the output shaft 4 is joined at the center of the carrier plate 16 in the radial direction.

The internal ring gear 15 is integrally formed at the inner circumferential surface of the top plate 12. A sliding bearing 12*a* is disposed at the center of the bottom of the top plate 12 in the radial direction thereof. The sliding bearing 12*a* is a member that rotatably supports one end of the output shaft 4 arranged on the same axis as that of the rotational shaft 52.

In addition, a housing 17 for fixing the starter 1 to the engine (not shown) is joined to the top plate 12. The housing 17 is formed in a cylindrical shape having a bottom. The top plate 12 is joined to the side of an opening 17*a* of the housing 17 so as to close the opening 17*a*.

A female screw section 17*b* is engraved and disposed at the outer circumferential surface of the side of the opening 17*a* of the housing 17 along the axial direction.

Meanwhile, a bolt hole 55*a* is formed at a position corresponding to the female screw section 17*b* in the end plate 55 arranged at the side of one end (right end side in FIG. 1) of the yoke 53 of the DC motor 51 with brush. A bolt 91 is screwed in the bolt hole 55*a* and the bolt 91 is screwed in the female screw section 17*b* so that the motor section 3 and the housing 17 are integrated each other.

Furthermore, a sliding bearing 17*d* which rotatably supports one end of the output shaft 4 at the center of a bottom 17*c* in the radial direction is disposed at the housing 17.

A concave section 4*a* that the other end of the rotational shaft 52 can insert is formed at one end of the output shaft 4. A sliding bearing 4*b* is press-fitted in the inner circumferential surface of the concave section 4*a*. The output shaft 4 and the rotational shaft 52 are connected each other to be respectively rotatable in the sliding bearing 4*b*.

A helical spline 19 is formed at the outer circumferential surface in the substantial center of the output shaft 4 in the axial direction. Substantially a cylindrical clutch outer 18 configuring a clutch 5 is meshed with the helical spline 19. A sleeve 18*a* formed by decreasing the diameter at the side of the motor section 3 is integrally molded with the clutch outer 18. A helical spline 18*b* meshed with the helical spline 19 is formed at the inner circumferential surface of the sleeve 18*a*.

In order to facilitate the relative movement of the clutch outer 18, grease (not shown) or the like is coated between the output shaft 4 and the clutch outer 18 which are engaged through helical spline.

A stopper plate 20 is disposed at the side of the other end (left side in FIG. 1) rather than the helical spline 19 of the output shaft 4. A second return spring 21 formed to surround the output shaft 4 is compressed and deformed, and disposed between the stopper plate 20 and the sleeve 18*a* of the clutch outer 18. Accordingly, the clutch outer 18 is always biased to push back to the side of the motor section 3.

A ring-shaped stopper 94 regulating the displacement to the side of the motor section 3 of the clutch outer 18 is disposed on the inner wall of the housing 17. The stopper 94 is formed of resin, rubber or the like and is configured to relieve the impact when the clutch outer 18 abuts the stopper 94.

In addition, a clutch inner 22 constituting the clutch 5 is engaged at the clutch outer 18, with non-displaced in the axial direction and non-rotatable relative to the clutch outer 18.

Here, when a torque difference and a rotational speed difference which occur between the clutch outer 18 and the clutch inner 22 are within predetermined values, the clutch 5 transmits the rotational force to each other. Meanwhile, when the torque difference and the rotational speed difference which occur between the clutch outer 18 and the clutch inner 22 are over predetermined values, the clutch 5 blocks the transmission of the rotational force.

The clutch inner 22 of the clutch 5 is formed in substantially cylindrical shape. The clutch inner 22 is inserted on the outside of the output shaft 4 with slidable to the output shaft 4. In order to avoid interference with the stopper plate 20, a concave section 22*a* is formed at the side of one end of the clutch inner 22 corresponding to the stopper plate 20.

(Gear Mechanism)

Meanwhile, the pinion 6 is integrally formed at the side of the other end of the clutch inner 22. The pinion 6 is a member constituting one side of the gear mechanism 120. The pinion 6 is configured of a cylinder section 71 slidably inserted in the outside of the output shaft 4 and an external gear section 72 integrally formed at an outer circumferential surface of the external gear section 72 and meshed with an idle gear 80 (described later). Thus, the cylinder section 71 and the clutch inner 22 are integrally molded.

In addition, an outer flange section 73 is integrally molded at the side of the clutch 5 that is the side of the base end of the cylinder section 71. Furthermore, at a distal end side of the cylinder section 71, a cylindrical boss section 74 formed by decreasing the diameter than the cylinder section 71 is integrally molded on the same axis of the cylinder section 71. A pair of sliding bearings 6*a* and 6*b* are press-fitted and fixed in the inner circumferential surfaces of the cylinder section 71 and the boss section 74.

A pinion washer 75 is inserted into and fixed to the outside of the boss section 74. The pinion washer 75 is regulated in the movement thereof in the slipping out direction by a retaining ring 76 attached to the boss section 74. Thus, the idle gear 80 constituting the other side of the gear mechanism 120 is interposed between the pinion washer 75 and the outer flange section 73.

The idle gear 80 is axially supported by idle shaft 81 provided in the housing 17.

Figure 2:
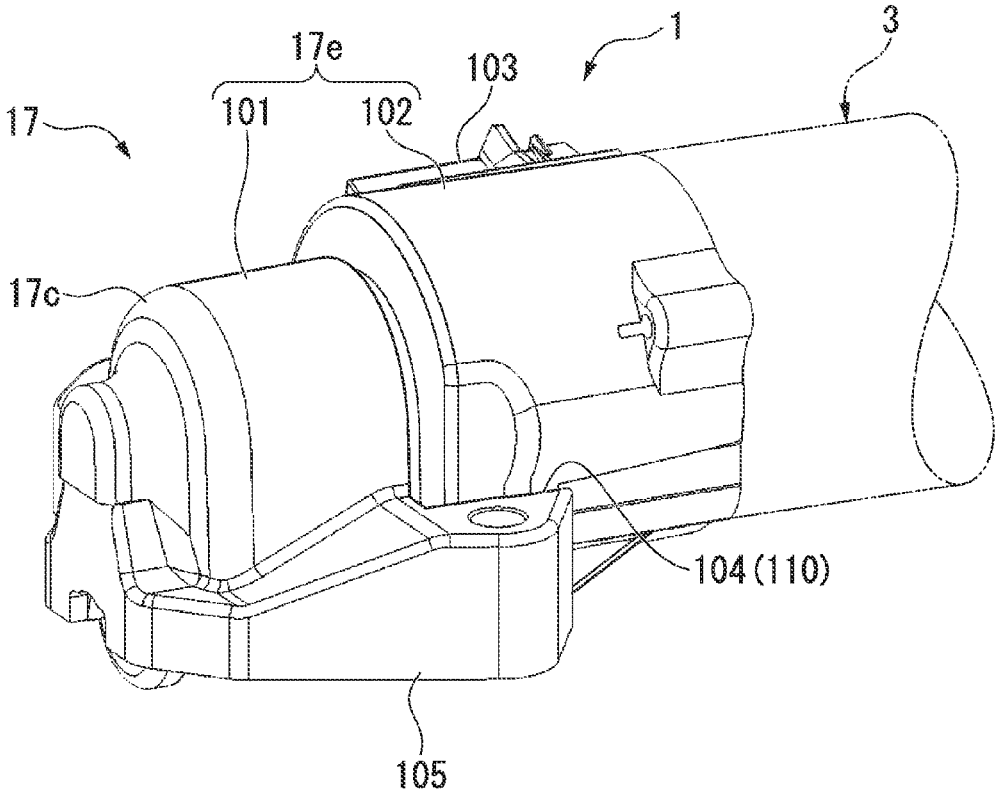
FIG. 2 is a perspective view of a housing seen from one side thereof in a first embodiment of the invention.
Figure 3:
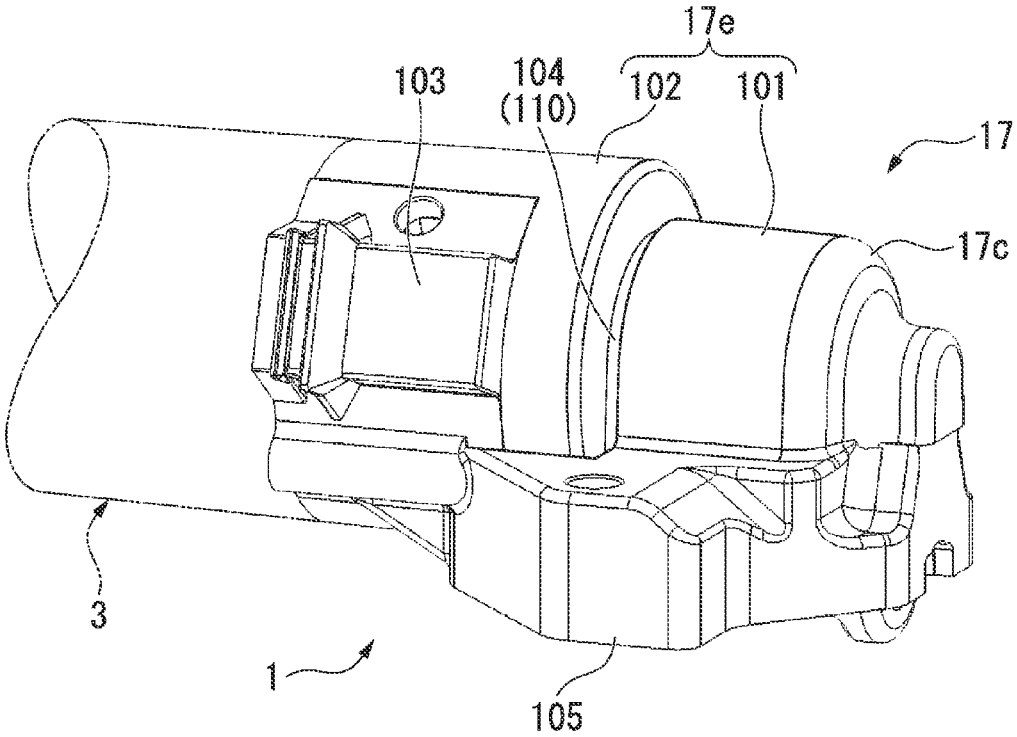
FIG. 3 is a perspective view of the housing seen from another side thereof in a first embodiment of the invention.

Here, a flange section 105 is formed at one side of the housing 17 to fix the housing 17 to the engine (not shown) at a position corresponding to the idle gear 80 at one side of the housing 17 (see FIGS. 1 to 3). The idle shaft 81 can also be fixed to the flange section 105. More specifically, at the flange section 105, the idle gear 80 and an opening 77 in which the idle shaft 81 is exposed to one side thereof, and at the same time, an insertion hole 78 in which the idle shaft 81 can be inserted from the bottom 17*c* is formed.

The insertion hole 78 is formed such that the axial direction thereof is parallel to the axial direction of the output shaft 4. The idle shaft 81 inserted in the insertion hole 78 formed as described above is configured to be regulated the movement in the slipping out direction and the rotation in the axial circumference direction by a set screw 79 screwed in from the flange section 105 side.

The idle gear 80 which is axially supported to the idle shaft 81 includes a cylinder section 82 that is slidably inserted in the idle shaft 81 at the outside of the idle shaft 81, and a gear section 83 integrally formed at the outer circumferential surface of the cylinder section 82 meshed with the external gear section 72 of the pinion 6 and the ring gear 23 of the engine (not shown). A pair of sliding bearings 84*a* and 84*b* is pressed and fixed in the inner circumferential surface of the cylinder section 82. The idle gear 80 is slidably and axially supported to the idle shaft 81 by the pair of the sliding bearings 84*a* and 84*b*.

In addition, a disk-shaped collar 84 is inserted at the outside of the cylinder section 82 and at the side of the clutch 5 of the gear section 83. The moving of the collar 84 toward the slipping out direction is regulated by a retaining ring 85 attached to the cylinder section 82. In addition, the outer diameter of the collar 84 is set to be substantially the same as the outer diameter of the external gear section 83. Furthermore, the thickness of the collar 84 and the gear section 83 in the axial direction is set to be substantially equal to or slightly smaller than the distance between the outer flange section 73 and the pinion washer 75 of the pinion 6.

In other words, the idle gear 80 is configured such that the external gear section 83 and the collar 84 are slidably pinched and held by the outer flange section 73 of the pinion 6 and the pinion washer 75. Thus, the idle gear 80 is configured to move on the idle shaft 81 with the pinion 6. Accordingly, the idle gear 80 is meshed with the ring gear 23 and the engagement of the idle gear 80 and the ring gear 23 is released.

Here, the collar 84 acts to improve the sliding property between the pinion 6 and the idle gear 80. The grease or the like as a lubricant is coated on the collar 84. In addition, a width W1 of the opening 77 formed in the housing 17 in the axial direction is set to a size in which the idle gear 80 is movable in the axial direction with the pinion 6.

(Electromagnetic Device)

In addition, in the inner circumferential surface of the housing 17, an exciting coil 24 formed in a substantially cylindrical shape and constituting the electromagnetic device 9 is provided at the side of the motor section 3 other than the clutch 5. The exciting coil 24 is accommodated in an accommodating concave section 25*b* formed by a cylindrical-shaped yoke 25 in which most of the center thereof in the radial direction is widely opened and which has a bottom, and a ring-shaped plunger holder 26 provided at the end section opposite to a bottom 25*a* of the yoke 25. The exciting coil 24 is electrically connected to an ignition switch (not shown) through a diode (not shown) provided in the switch unit 7 and a connector.

A substantially cylindrical switch plunger 27 formed of a magnetic material is slidably provided at the exciting coil 24 in the axial direction in a gap between the inner circumferential surface of the exciting coil 24 and the outer circumferential surface of the output shaft 4. Furthermore, a substantially cylindrical-shaped gear plunger 28 is provided in a gap between the switch plunger 27 and the outer circumferential surface of the output shaft 4.

The switch plunger 27 and the gear plunger 28 are provided with a concentric circle shape each other and are disposed to be relatively movable in the axial direction.

An outer flange section 29 is integrally molded at the end section of the side of the motor section 3 of the switch plunger 27. At the side of the outer circumferential surface of the outer flange section 29, a connecting rod 30 is erected and disposed along the axial direction. The connecting rod 30 penetrates the top plate 12 of the motor section 3. End section protruded from the top plate 12 of the connecting rod 30 connects the movable contact plate 8 of the switch unit 7 arranged adjacent to the commutator 61 of the DC motor 51 with brush.

The movable contact plate 8 is slidably attached to the connecting rod 30 along the axial direction, and at the same time, is supported to be floated by a coil spring 32. Thus, the movable contact plate 8 is provided so as to approach and separate from a fixed contact plate 34 of the switch unit 7 fixed at a brush stay 33 which is provided around the commutator 61.

The fixed contact plate 34 is configured such that a first fixed contact plate 34*a* arranged at the inside in the radial direction that is the side of the commutator 61 and a second fixed contact plate 34*b* arranged to the outside in the radial direction that is opposite to the commutator 61 are separated across the connecting rod 30. The movable contact plate 8 abuts the first fixed contact plate 34*a* and the second fixed contact plate 34*b* to hang over therebetween. The movable contact plate 8 abuts the first fixed contact plate 34*a* and the second fixed contact plate 34*b* and thereby both fixed contact plates 34*a* and 34*b* are conductive.

In addition, the switch plunger 27 is biased and disposed at the side of the motor section 3 by a first return spring 35 compressed and provided between the outer flange section 29 and the inner wall of the housing 17. Thus, the switch plunger 27 is usually stationary in an opened state (the state above the center line in FIG. 1) between contact points.

Meanwhile, the gear plunger 28 is a member formed of the resin. A ring-shaped iron core 28*a* is installed at the outer circumferential surface of the gear plunger 28 in the motor section 3 side. A substantially disk-shaped the concave section 28*b* of the gear plunger 28 in the plan view in the axial direction is formed at the motor section 3 side. The concave section 28*b* accommodates a shift spring 36 formed so as to surround the output shaft 4.

In addition, at the inner circumferential surface of the switch plunger 27, a substantially disk-shaped saucer 48 in the plan view in the axial direction is provided at a position corresponding to the end section of the shift spring 36. The movement of the shift spring 36 in the axial direction is regulated by the saucer 48 and a bottom surface of a concave section 28*b* of the gear plunger 28.

At the brush stay 33 to which the fixed contact plate 34 of the switch unit 7 is fixed, a plurality of brushes 41 are disposed around the commutator 61 so as to be advanced and retraced. A coil spring 42 is provided at the base end side of each of the brushes 41. Each of the brushes 41 is biased to the side of the commutator 61 by the coil spring 42 and the tip of each of the brushes 41 slidably contacts the segment 62 of the commutator 61.

The brushes 41 are configured of an anode side brush and a cathode side brush. The anode side brush is connected to the first fixed contact plate 34*a* of the fixed contact plate 34 through a pigtail (not shown).

Meanwhile, the anode of the battery (not shown) is electrically connected to the second fixed contact plate 34*b* of the fixed contact plate 34 through a terminal bolt 44.

In other words, when the movable contact plate 8 abuts the fixed contact plate 34, the voltage applies to the anode side brush of the brush 41 through the terminal bolt 44, the fixed contact plate 34 and the pigtail (not shown), and the current is supplied to the coil 59.

The terminal bolt 44 includes a cover 45 to attach to the starter 1. The cover 45 is fixed in a pinched state by a yoke 10 and the housing 17.

In addition, the cathode side brush of the brush 41 is connected to a center plate 43 described below through the pigtail (not shown). Thus, the cathode side brush of the brush 41 is electrically connected to the cathode of the battery through the center plate 43, the housing 17 and a vehicle body (not shown).

The ring-shaped center plate 43 formed of the metal is disposed between the brush stay 33 and the top plate 12. The center plate 43 is a member to separate between the planetary gear mechanism 2 and the DC motor 51 with brush. A cylinder section 43*a* protrudes to the side of the commutator 61 and disposed substantially at the center of the center plate 43 in the radial direction.

The inner diameter of the cylinder section 43*a* is set to be slightly larger than the diameter of the rotational shaft 52. A micro gap is formed between the cylinder section 43*a* and the rotational shaft 52. The end section of the cylinder section 43*a* is accommodated in a concave section 61*a* formed the end surface of the commutator 61. As a result, the grease of the planetary gear mechanism 2 is prevented from leaking to the commutator 61.

(Effect of Housing and Fragile Section Formed in Housing)

FIG. 2 is a perspective view of the housing seen from one side thereof. FIG. 3 is a perspective view of the housing seen from another side thereof.

Here, as shown in FIGS. 1 to 3, the housing 17 is configured such that the side of the opening 17*a* in which the electromagnetic device 9 and the switch unit 7 are accommodated is formed by a step with a diameter larger than a portion in which the clutch 5 and the pinion 6 are accommodated. In other words, a circumferential wall 17*e* of the housing 17 is configured by continuously forming a small diameter section 101 of the side of the bottom 17*c* and a large diameter section 102 of the opening 17*a* side.

In addition, a switch accommodating section 103 is integrally molded at a position corresponding to the switch unit 7 of the large diameter section 102. Furthermore, the flange section 105 formed at one side of the housing 17 is extended and provided from the bottom 17*c* to a portion which is led slightly to the side of the small diameter section 101 than substantially the center of the large diameter section 102 in the axial direction.

At the small diameter section 101 of the housing 17 configured described above, a groove section 104 is formed continuously along a connecting section with the large diameter section 102 and a connecting section with the flange section 105.

In other words, the groove section 104 is formed at the connecting sections with the small diameter section 101 and the large diameter section 102 which are positioned at the side of the bottom 17*c* other than the switch accommodating section 103. In addition, the groove section 104 is formed at the connecting sections with the small diameter section 101 and the flange section 105 so as to avoid the switch accommodating section 103 of the housing 17.

The groove section 104 is formed at the housing 17 and thereby the position where the groove section 104 is formed is decreased in stiffness. In other words, the groove section 104 functions as a fragile section 110 on which the stress of the load applied to the housing 17 due to, for example, collision or the like at the front of the vehicle is concentrated.

Describing more specifically, for example, when an excessive load is applied to the starter 1 during a collision or the like at the front of the vehicle, since the flange section 105 of the housing 17 is fixed to the engine (not shown), an inertial force acts on the motor section 3 and the motor section 3 is shaken about the flange section 105 as the reference point.

When the motor section 3 is shaken, a bending load is applied to the housing 17. At this time, the groove section 104 that is the fragile section 110 is formed in the housing 17 so that the stress concentrates in the groove section 104. Thus, the housing 17 bends and deforms about the groove section 104 as its center. Since the groove section 104 is formed so as to avoid the switch accommodating section 103, the deformation of the connecting rod 30, for example, slidably moving the movable contact plate 8 is prevented. In other words, the deformation of the switch unit 7 is prevented.

Accordingly, for example, when an excessive load is applied to the starter 1 during a collision or the like at the front of the vehicle, the fixed contact plate 34 and the movable contact plate 8 can be prevented from contacting and the supply of the electric power to the motor section 3 can be reliably prevented.

(Operation of Starter)

Next, the operation of the starter 1 is described based on FIG. 1.

As shown in the same view, at first, in a stationary state before the current is supplied to the exciting coil 24, the switch plunger 27 is biased by the first return spring 35 and thereby fully moves to the side of the motor section 3 (right side in FIG. 1). Thus, the switch plunger 27 stops in a state where the outer flange section 29 abuts the top plate 12. Thus, the movable contact plate 8 disposed at the connecting rod 30 that is erected and disposed at the outer flange section 29 is separated from the fixed contact plate 34.

At the same time, the clutch outer 18 biased by the second return spring 21 fully moves the clutch inner 22 and the gear plunger 28 which are integrally formed with the pinion 6 to the motor section 3. Thus, the clutch outer 18 of the clutch 5 stops at a position abutting on the stopper 94 and the engagement of the pinion 6 and the ring gear 23 is separated.

When the ignition switch is turned to ON from this state, the current is supplied to the exciting coil 24 and thereby the exciting coil 24 is excited. Thereupon, a magnetic path is formed where the magnetic flux passes through the switch plunger 27 and the gear plunger 28. Thus, the switch plunger 27 and the gear plunger 28 move to the side of the ring gear 23 (left side in FIG. 1).

At this time, a gap (a clearance in the axial direction) between the switch plunger 27 and the plunger holder 26 is smaller than that of the iron core 28*a* of the gear plunger 28, thereby an attraction force is large. Thus, the switch plunger 27 moves prior to the gear plunger 28.

Here, the spring force of the shift spring 36 is set weaker than the spring force of the second return spring 21 provided at the clutch outer 18 in a state where the pinion 6 is stationary.

In addition, the spring force of the shift spring 36 is set stronger than the spring force of the second return spring 21 during leading to a compressed state into a maximum by the switch plunger 27 moving prior to the gear plunger 28.

In other words, since the spring force of the shift spring 36 is weaker than the spring force of the second return spring 21, the stationary state of the gear plunger 28 is maintained in the initial step of the attracting and moving of the switch plunger 27 and thereby the shift spring 36 is firstly compressed and deformed.

When the switch plunger 27 moves toward the ring gear 23 side, the movable contact plate 8 moves to the side of the fixed contact plate 34 through the outer flange section 29 and the connecting rod 30, and contacts the fixed contact plate 34. At this time, the movable contact plate 8 contacts the fixed contact plate 34 early in a full stroke of the switch plunger 27 and the movable contact plate 8 is displaceable in the axial direction and is floated and supported at the connecting rod 30. Thus, the pressing force of the coil spring 32 applies between both contact plates 8 and 34.

When the movable contact plate 8 contacts the fixed contact plate 34, the voltage of the battery applies to the anode side brush of the brush 41. Thus, the coil 59 is conductive through the segment 62 of the commutator 61.

Thereupon, magnetic field is generated at the armature core 58. Thus, the magnetic attraction force or the reaction force is generated between the magnetic field and the permanent magnet 57 provided at the yoke 10. As a result, the armature 54 rotates continuously.

The armature 54 rotates and thereby the rotational force of the rotational shaft 52 of the armature 54 is transmitted to the output shaft 4 through the planetary gear mechanism 2 and the output shaft 4 rotates. The output shaft 4 rotates and thereby the clutch outer 18 meshed with the helical spline 19 of the output shaft 4 also rotates and the inertial force acts on the clutch 5. Thus, the clutch 5 is pushed to the side of the ring gear 23 against the spring force of the second return spring 21 along the helical spline 19 by the inertial force.

Here, at the gear plunger 28, a force acts toward the ring gear 23 side. Thus, the gear plunger 28 also moves to the side of the ring gear 23 according to the movement of the clutch 5.

The clutch 5 is pushed to the side of the ring gear 23 and thereby the pinion 6 integrally formed with the clutch 5 is pushed while rotating toward the ring gear 23 side. Thereupon, the idle gear 80 is pushed with the pinion 6. Thus, the ring gear 23 and the gear section 83 of the idle gear 80 are meshed each other and the rotational force of the output shaft 4 is transmitted to the ring gear 23 (the below the center line in FIG. 1).

In other words, the clutch 5 and a portion where the helical spline 19 of the output shaft 4 is formed in which the clutch outer 18 of the clutch 5 is engaged, move the pinion 6 or the idle gear 80 and thereby function as the gear movement mechanism that meshes the idle gear 80 with the ring gear 23. Thus, the ring gear 23 and the gear section 83 of the idle gear 80 engage and the rotational force of the output shaft 4 is transmitted to the ring gear 23 so that engine starts.

Here, when the rotation of the armature 54 is to be stable and the acceleration is stopped, the inertial force is weakened, which moves the pinion 6 to the side of the ring gear 23 due to the rotation of the output shaft 4 and engagement of the helical spline. However, a force acts to the side of the ring gear 23 with the gear plunger 28 and thereby the force increases the propulsive force which moves the pinion 6 and the idle gear 80 toward the ring gear 23 side. Thus, the external gear section 83 of the idle gear 80 is meshed toward the ring gear 23 having a larger inrush force.

Furthermore, a force acts toward the side of the ring gear 23 at the gear plunger 28. Thus, the meshing state of the pinion 6 with the ring gear 23 is reliably maintained by this force and a restoring force of the shift spring 36.

Thus, at the meshed position with the pinion 6, the clutch outer 18 abuts the stopper plate 20. The moving of the clutch outer 18 toward the axial direction is regulated by the stopper plate 20.

Successively, when the engine starts and the number of rotations of the pinion 6 is more than that of the output shaft 4, the clutch 5 acts and thereby the pinion 6 runs idle. In this state, the ignition switch is turned to OFF and the conductivity toward the exciting coil 24 is stopped based on the signal from the control equipment (not shown). More specifically, the control equipment (not shown) outputs a signal that shut off the conductivity to the exciting coil 24 when the number of rotations of the ring gear 23 becomes, for example, equal to about 400 rpm or more. In addition, the number of rotations of the ring gear 23 is detected using a rotation sensor (not shown) or the like provided at the vehicle body.

Here, when the conductivity to the exciting coil 24 is stopped, the magnetic path which is formed where the magnetic flux passes through the switch plunger 27 and the gear plunger 28 is demagnetized. Thus, the biasing force to the side of the ring gear 23 of the switch plunger 27 and the gear plunger 28 due to the exciting coil 24, does not act. Furthermore, the biasing force of the second return spring 21 against the clutch outer 18 and the biasing force of the first return spring 35 against the switch plunger 27 act. Accordingly, the idle gear 80 is detached from the ring gear 23, and the idle gear 80 and the pinion 6 go back. In addition, at the same time, the movable contact plate 8 is separated from the fixed contact plate 34 and thereby the DC motor 51 with brush stops.

(Advantage)

According to the first embodiment described above, the groove section 104 is formed continuously at the small diameter section 101 of the housing 17 so as to run alongside to the connecting section with the large diameter section 102 and the connecting section with the flange section 105. Thus, for example, when an excessive load is applied to the starter 1 during a collision or the like at the front of the vehicle, the fixed contact plate 34 and the movable contact plate 8 can be prevented from contacting and the supply of the electric power to the motor section 3 can be reliably prevented.

In addition, the groove section 104 is formed in the housing 17 and the groove section 104 is functioned as the fragile section 110 where the stress of the load is concentrated so that the fragile section 110 can be formed with low cost.

Second Embodiment (Starter)

Figure 4:
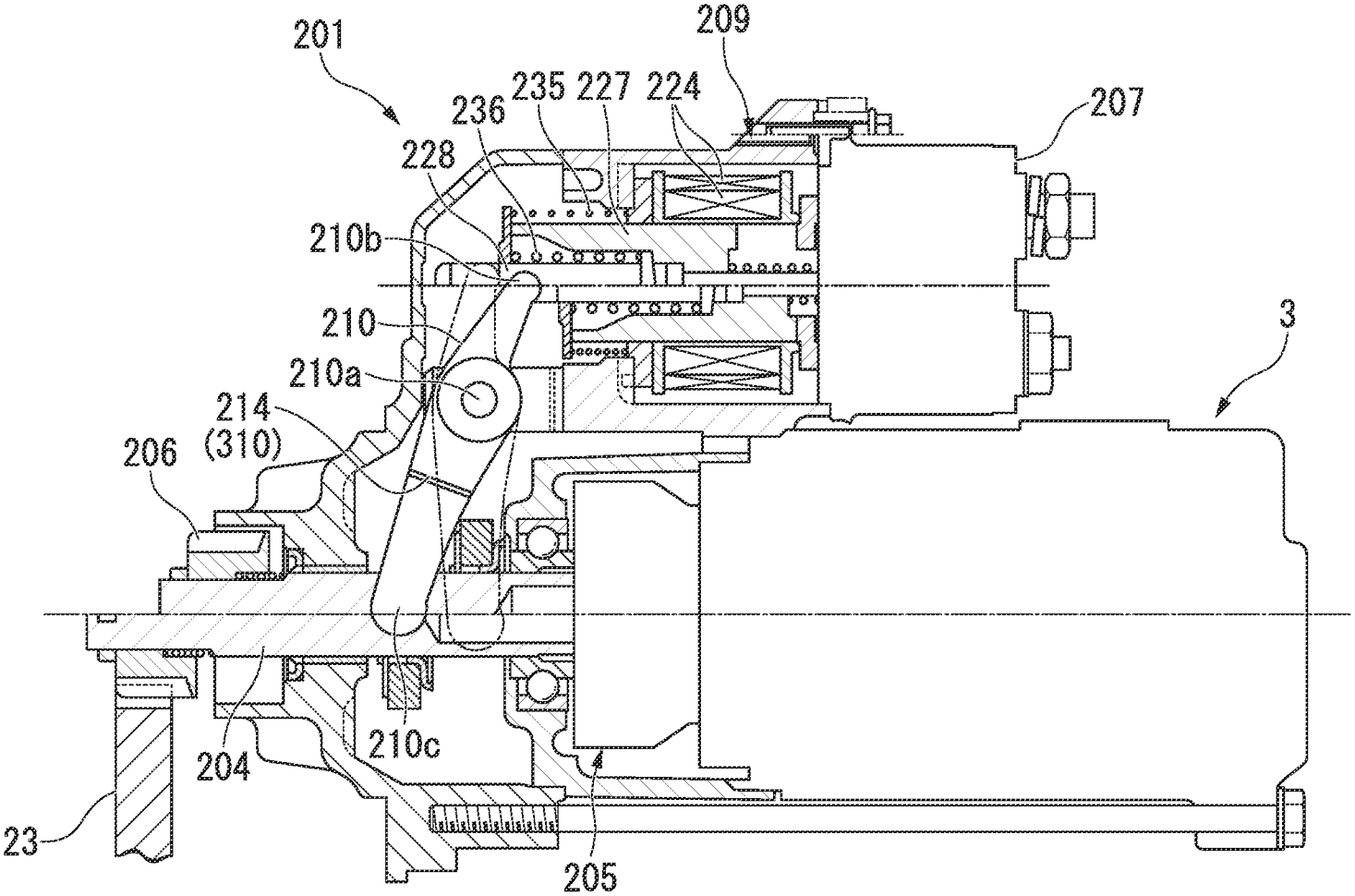
FIG. 4 is a partial cross-sectional side view of a starter in a second embodiment of the invention.

Next, a second embodiment of the present invention is described based on FIG. 4. In addition, the same numerals are applied to the same aspects of the first embodiment and are described.

FIG. 4 is a partial cross-sectional side view of the starter in the second embodiment and a stationary state is shown above the center line and a conducting state is shown in the lower side.

As shown in the same view, a starter 201 of the second embodiment has the motor section 3, a pinion shaft 204 connected to the motor section 3 through a clutch 205, a pinion 206 supported on the pinion shaft 204 and an electromagnetic device 209 connected to the pinion shaft 204 through a shift lever 210.

The electromagnetic device 209 includes a switch unit 207 closing and opening the power supply path to the motor section 3, an exciting coil 224 and a plunger 227 driven by the electromagnetic attraction force due to the magnetic field formed by the conductivity to the exciting coil 224. The plunger 227 is biased by a return spring 235 and a drive spring 236 accumulating the reaction force for meshing the pinion 206 with the ring gear 23 so as to be pushed back when the exciting coil 224 is demagnetized.

The plunger 227 and a shift rod 228 are connected through the drive spring 236. The shift rod 228 is a member for transmitting the movement of the plunger 227 to the shift lever 210.

The switch unit 207 includes a set of fixed contacts and a movable contact intermitting a set of fixed contacts (all is not shown). The movable contact is configured so as to move integrally with the plunger 227. Thus, when the movable contact contacts the fixed contact, the conductivity is performed between a set of fixed contacts and power is supplied to the motor section 3.

The shift lever 210 includes a lever fulcrum section **210*a* that is supported swingably. A lever end section 210*b* of one end side of the lever fulcrum section 210*a* is connected to the shift rod 228 and a lever end section 210*c* of the other end side of the lever fulcrum section 210*a* is engaged with the pinion shaft 204. Thus, the shift lever 210 transmits the movement of the plunger 227 to the pinion shaft 204**.

In other words, when the plunger 227 is attracted to the exciting coil 224 and moves to the side of the switch unit 207 (right side in FIG. 4), the lever end section **210*b* connected to the shift rod 228 is attracted and moves to the plunger 227. Thus, the lever end section 210*c* is swung around the lever fulcrum section 210*a* and thereby the pinion shaft 5 is pushed to the side (left side in FIG. 4) opposite the motor section 3. As a result, the pinion 206 meshes with the ring gear 23 and the rotational force of the motor section 3 is transmitted to the ring gear 23** so that the engine starts.

Here, a groove section 214 is formed at the shift lever 210 along a direction substantially orthogonal to the longitudinal direction. Accordingly, the position where the groove section 214 of the shift lever 210 is formed is decreased in the stiffness thereof, in other words, the groove section 214 is functioned as a fragile section 310 where the stress of the load of the shift lever 210 due to a collision or the like at the front of the vehicle is concentrated.

More specifically, for example, when the load is applied to the side of the motor section 3 of the starter 201, the load is transmitted to the side of the electromagnetic device 209 through the shift lever 210. Here, for example, when an excessive load is applied during a collision or the like at the front of the vehicle, an excessive bending load is applied to the shift lever 210.

At this time, since the groove section 214 is formed at the shift lever 210, the stress is concentrated at the groove section 214. Thus, the shift lever 210 bends and deforms about the groove section 214 as its center. As described above, when the load over the predetermined value applies to the shift lever 210, the load is prevented from transmitting to the electromagnetic device 209 side.

According to the second embodiment described above, the same advantage can be achieved as the first embodiment described above.

In addition, in the second embodiment described above, the description is given in a case which when the groove section 214 is formed at the shift lever 210 and the load is applied to the shift lever 210, the shift lever 210 bends and deforms about the groove section 214 as its center. However, the invention is not limited to the description and when an excessive load is applied to the motor section 3 side, the shift lever 210 may be configured to block the transmission of the load to the electromagnetic device 209 side. More specifically, a description is given based on FIGS. 5 and 6.

First Modified Example of Second Embodiment

Figure 5:
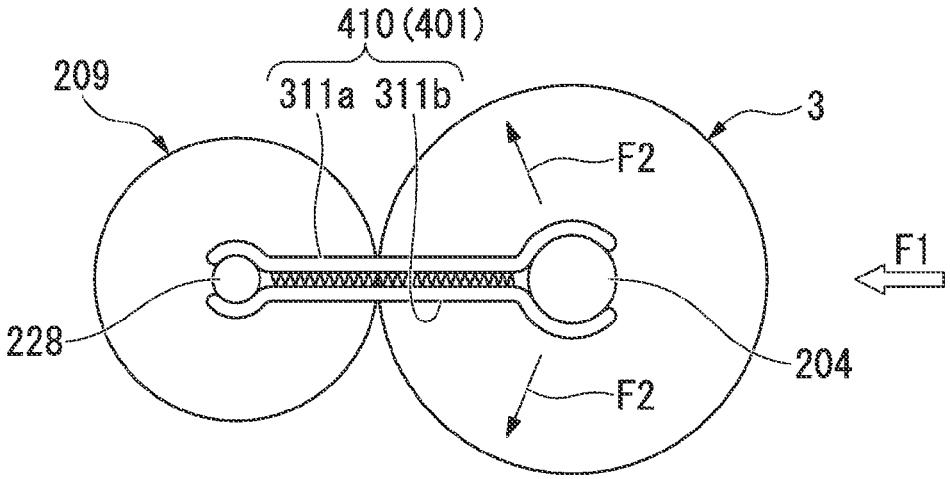
FIG. 5 is a schematic block diagram of a shift lever in a first modified example of the second embodiment of the invention.

FIG. 5 is a schematic block diagram of a shift lever in a first modified example.

As shown in the same view, a shift lever 410 of the first modified example is configured such that a pair of lever pieces 311*a* and 311*b* is joined to overlap to each other. In addition, the motor section 3 and the electromagnetic device 209 are respectively arranged side by side along the direction of the force of the load F1 which is applied to the motor section 3.

In other words, the shift lever 410 is provided so as to position the pair of the lever pieces 311*a* and 311*b* at both sides about the direction of the force of the load F1 which is applied to the motor section 3. As described above, the pair of the lever pieces 311*a* and 311*b* are detachably joined to each other when the load F1 exceeds a predetermined value.

According to the configuration described above, when the load F1 applies to the motor section 3, for example, due to a collision with the front of the vehicle, a force F2 that is directed in a direction away from each other acts on the pair of the lever pieces 311*a* and 311*b* of the shift lever 410. At this time, when the load F1 exceeds the predetermined value, the pair of the lever pieces 311*a* and 311*b* are away from each other. Thus, the connection between the pinion shaft 204 and the shift rod 228 of the electromagnetic device 209 through the shift lever 410 is released.

In other words, the pair of the lever pieces 311*a* and 311*b* constituting the shift lever 410 functions as an easy releasing section 401 so as to easily release the connection between the pinion shaft 204 and the shift rod 228, for example, during a collision at the front of the vehicle. Thus, the load F1 which is applied to the motor section 3 is prevented from transmitting to the electromagnetic device 209. Accordingly, the same advantage can be achieved as the first embodiment described above.

Second Modified Example of Second Embodiment

Figure 6:
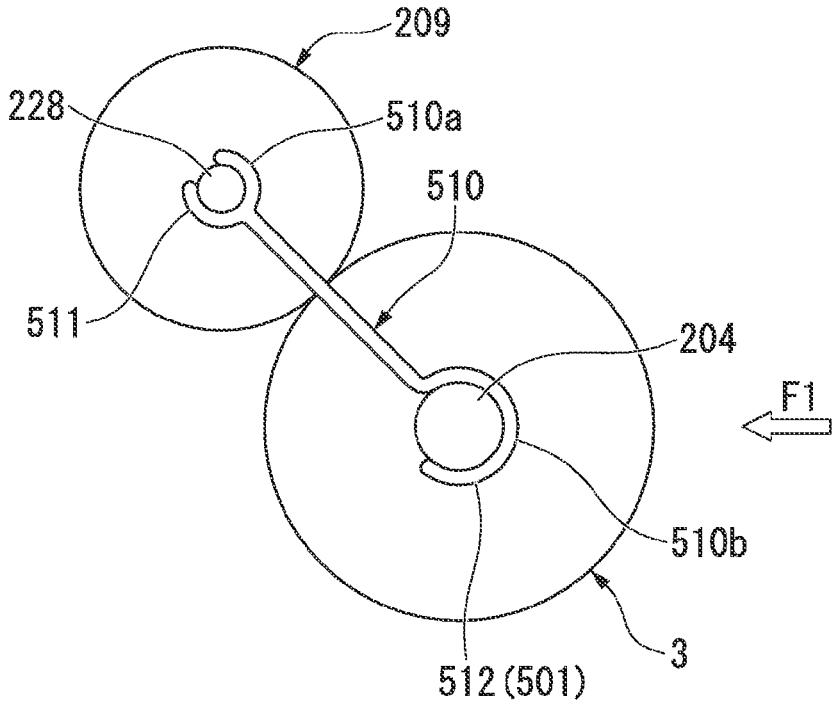
FIG. 6 is a schematic block diagram of a shift lever in a second modified example of the second embodiment of the invention.

FIG. 6 is a schematic block diagram of a shift lever in a second modified example.

As shown in the same view, a shift lever 510 of the second modified example includes hook sections 511 and 512 at a lever end section 510*a* of one end side and a lever end section 510*b* of the other end side respectively. The hook section 512 connected to the pinion shaft 204 of the side of the motor section 3 among the hook sections 511 and 512 is provided so as to open to the direction of the force of the load F1 which is applied to the motor section 3.

In addition, the motor section 3 and the electromagnetic device 209 are respectively arranged side by side orthogonal to the direction of the force of the load F1 which is applied to the motor section 3 respectively. In other words, the shift lever 510 is provided in which the longitudinal direction thereof is orthogonal to the direction of the force of the load F1 which is applied to the motor section 3.

In the configuration described above, for example, when the load F1 applies to the motor section 3 due to a collision or the like at the front of the vehicle, the pinion shaft 204 displaces in a deviating direction (in the left side in FIG. 6) from the hook section 512. Thus, the connection between the shift lever 510 and the pinion shaft 204 is released. In other words, the hook section 512 disposed at the lever end section 510*b* of the other side of the shift lever 510 functions as an easy releasing section 501 so as to easily release the connection between the pinion shaft 204 and the shift rod 228, for example, during a collision with the front of the vehicle.

Thus, the load F1 which is applied to the motor section 3 is prevented from transmitting to the electromagnetic device 209 and the same advantage as the first embodiment described above can be achieved.

In addition, the invention is not limited to the embodiments described above and various changes can be added to the embodiments described above within a range not departing from the spirit of the invention.

For example, in the first embodiment described above, the description is given of a case where the groove section 104 is set at the housing 17 and the groove section 104 is set as the fragile section 110. However, the invention is not limited to the embodiment, and any configuration may be sufficient if the stiffness of the housing 17 is decreased and the stress of the load can be concentrated. For example, instead of the groove section 104, a thin section which is thinner than the thickness of the other sections may be formed at the small diameter section 101 of the housing 17 and the thin section may be set as the fragile section 110.

In addition, the cross-sectional shape of the groove section 104 is not specifically limited and various shapes such as a round groove or a V-shaped groove can be employed.

Furthermore, in the first embodiment described above, the description is given in a case where the groove section 104 is formed in the small diameter section 101 of the housing 17 so as to run alongside the connecting section with the large diameter section 102 and the connecting section with the flange section 105. However, the invention is not limited to the configuration, and the groove section 104 may be formed so as to avoid the position where the switch unit 7 of the housing 17 is arranged.

Thus, in the first embodiment described above, the description is given in a case where the motor section 3, the electromagnetic device 9, the output shaft 4 and the pinion 6 of the starter 1 are arranged on the same axis thereof. Thus, the description is given in a case where the output shaft 4 rotates according to the driving of the motor section 3 and thereby the inertial force generated in the clutch 5 is used and the pinion mechanism 70 is moved to the side of the ring gear 23. However, the invention is not limited to the configuration, and the groove section may be formed so as to avoid the position where the switch unit is arranged even in the housing of the starter, for example, configured to arrange the electromagnetic device 9 at the outside of the motor section 3 in the radial direction and to slidably move the pinion mechanism using shift lever.

In addition, in the first embodiment described above, the description is given in a case where the groove section 104 is formed at the housing 17 of the starter 1 in which the rotational force of the output shaft 4 is transmitted to the ring gear 23 through the pinion 6 and the idle gear 80, in other words, a side-mounted type. However, the invention is not limited to the configuration, and the groove section 104 may also be formed in a housing of the starter of a type in which the pinion is meshed with the ring gear directly and thereby the rotational force of the output shaft is transmitted to the ring gear.

Hereinabove, preferred embodiments of the invention are described, however, the invention is not limited to the embodiments. Adding, omitting, substituting or other change of the configuration can be performed within the range without departing the spirit of the invention. The invention is not limited by the above description and is defined only by the range of the annexed claims.

What is claimed is:

1. A starter comprising:

a motor section;

a housing which has a first side integrally formed continuous from the motor and a second side continuous from the first side and formed with a fixing section to be fixed to an engine, an output shaft which is housed in the housing, and which rotates by receiving a rotational force of the motor section;

a gear mechanism which is housed in the housing, and which transmits a rotational force of the output shaft to a ring gear of an engine;

a contact mechanism which is housed in the first side of the housing, and which performs electrical connection and disconnection to the motor section by contacting and separating a movable contact and a fixed contact according to ON and OFF of an ignition switch; and a gear movement mechanism which moves the gear mechanism according to the operation of the electrical connection and disconnection of the contact mechanism and coordinates the gear mechanism and the ring gear, wherein a fragile section is formed at a portion, between the contact mechanism and the fixing section on the housing, which avoids the contact mechanism so as to prevent a stress from being applied to the contact mechanism when the starter is shaken about the fixing section fixed to the engine as a reference point, and the fragile section is a housing groove section for weakening the stiffness of the housing.

2. The starter according to claim 1, wherein the gear movement mechanism comprises a lever connecting the gear mechanism and the contact mechanism, and a lever groove section for reducing the stiffness of the lever is formed at the lever and the lever groove section is set as the fragile section.

3. The starter according to claim 1, wherein the gear movement mechanism comprises a lever connecting the gear mechanism and the contact mechanism, and an easy releasing section which easily releases the connection of at least one of the gear mechanism and the contact mechanism with the lever, is disposed at the lever.

4. The starter according to claim 1, wherein the output shaft and the gear mechanism are disposed in the second side of the housing, and the contact mechanism is disposed in the first side of the housing, and the housing groove section is formed in the second side of the housing.

5. The housing according to claim 1, wherein the housing groove section is formed over an entire circumferential direction of the housing.

6. The starter according to claim 4, wherein the housing groove section is formed over an entire circumferential direction of the housing.

* * * * *